US005465584A

United States Patent [19]

Mattern-Klosson et al.

[11] Patent Number: 5,465,584

[45] Date of Patent: Nov. 14, 1995

[54] CRYOPUMP

[75] Inventors: Monika Mattern-Klosson, Roesrath; Hans-Juergen Mundinger, Bruehl; Ferdinand Greger, Cologne, all of Germany

[73] Assignee: Leybold Aktiengesellschaft, Cologne, Germany

[21] Appl. No.: 204,270

[22] PCT Filed: Apr. 18, 1992

[86] PCT No.: PCT/EP92/00865

§ 371 Date: Mar. 8, 1994

§ 102(e) Date: Mar. 8, 1994

[87] PCT Pub. No.: WO93/05294

PCT Pub. Date: Mar. 18, 1993

[30] Foreign Application Priority Data

Sep. 10, 1991 [DE] Germany ..... 9111236 U

[51] Int. Cl.[6] ..... B01D 8/00

[52] U.S. Cl. ..... 62/55.5; 417/901

[58] Field of Search ..... 62/55.5; 417/901

[56] References Cited

U.S. PATENT DOCUMENTS

| | | | |
|---|---|---|---|
| 4,697,617 | 10/1987 | Bourke et al. | 137/549 |
| 4,724,677 | 2/1988 | Foster | 62/55.5 |
| 4,757,689 | 7/1988 | Bachler et al. | 62/55.5 |

FOREIGN PATENT DOCUMENTS

| | | |
|---|---|---|
| 0250613 | 1/1988 | European Pat. Off. . |
| 1937821 | 2/1970 | Germany . |
| 2620880 | 11/1977 | Germany . |
| 3512614 | 10/1986 | Germany . |
| 8804218 U | 5/1988 | Germany . |
| 60-088881 | 5/1986 | Japan . |
| 652804 | 11/1985 | Switzerland . |
| 1170824 | 11/1969 | United Kingdom . |
| 92/08894 | 5/1992 | WIPO . |

*Primary Examiner*—Ronald C. Capossel
*Attorney, Agent, or Firm*—Spencer, Frank & Schneider

[57] ABSTRACT

The invention relates to a cryopump operated with a refrigerator, having a housing, having an inlet valve, having heatable pumping surfaces and having a backing pump connected to the pump interior; to be able to regenerate the cryopump quickly by executing the removal of the condensed gases at a high pressure, it is proposed that it is equipped with a line for the precipitates to be removed and that is provided with a regeneration valve.

35 Claims, 3 Drawing Sheets

CRYOPUMP

BACKGROUND OF THE INVENTION

The invention relates to a cryopump comprising an exterior housing having an interior space formed therein. A refrigerator is at least partially located within the interior space for operating the cryopump. The refrigerator has at least one pumping surface located within the interior space. A heating element is attached to the pumping surface for heating the pumping surface. An inlet valve is attached to the housing and opens into the interior space. A backing pump is operatively connected to the interior space.

A cryopump operated with a cold source or a refrigerator is known from, for example, DE-OS 2,620,880. Pumps of this type conventionally have three pumping surface regions designated for the agglomeration of different types of gases. The first surface region is in thermally well-conductive contact with the first stage of the refrigerator and, depending on the type and capacity of the refrigerator, has an essentially constant temperature between 60 and 100 K. Conventionally, a radiation shield and a baffle are part of these surface regions. These components protect the pumping surfaces with lower temperatures against incident thermal radiation. The pumping surfaces of the first stage preferably serve in the agglomeration of gases that condense relatively simply, such as water vapor and carbon dioxide, by means of cryocondensation.

The second pumping surface region is in thermally-conductive contact with the second phase of the refrigerator. During pump operation, this stage has a temperature of approximately 20 K. The second surface region preferably serves to remove gases that can only be condensed at lower temperatures, such as nitrogen, argon or the like, likewise by means of cryocondensation.

The third pumping surface region likewise shares the temperature of the second stage of the refrigerator (correspondingly lower in a refrigerator having three stages), and is coated with an adsorption material. On these pumping surfaces, essentially the cryoadsorption of light gases, such as hydrogen, helium or the like, is intended to take place.

For regeneration of a cryopump, it is necessary to heat the pumping surfaces. This can take place by means of radiation, or with the aid of heated regenerative gases, which flow through the housing of the cryopump. A further possibility (see DE-OS 3,512,614) is to equip the pumping surfaces with electrical heating devices and put these into operation during the regeneration process. With the heating devices, when the backing pump connected to the interior of the pump is running, the pumping surfaces are heated to, for example, 70° C. until the backing pressure (approx. $10^{-2}$ mbar) is again reached after the precipitated gases are removed. A total regeneration of the pumps in accordance with these methods lasts for several hours, since the regeneration duration is a combination of the actual regeneration time and the time required for putting the pump back into operation, particularly for cold operation of the pumping surfaces.

Cryopumps are frequently used in semiconductor production technology. In many applications of this type, gases predominantly arise that only charge the pumping surfaces of the second stage. It is therefore known (see DE-OS 3,512,614) to execute regeneration only of the low-temperature pumping surfaces. This occurs by means of separate heating of the pumping surfaces of the second stage.

In all regeneration processes, the inlet valve, which is typically disposed upstream of the inlet opening of the cryopump, must be closed, that is, pump operation and hence production operation must be interrupted.

SUMMARY OF THE INVENTION

Therefore, it is the object of the present invention to create a cryopump that can regenerate significantly faster.

This object is attained in accordance with the invention by providing the cryopump with a regeneration valve having a heating element and a temperature sensor for controlling the heating element, and being connected by a discharge line with the interior space for the removal of precipitates formed therein.

In a cryopump of this type, it is possible that the removal of ice layers of condensed gases, which as a rule are relatively excessively thick, takes place at a pressure (regeneration pressure) that is above the pressure of the triple point, because of which high evaporation rates are possible without a regenerative gas being necessary that is expensive and quantity-increasing. Because the temperature of the pumping surface to be regenerated is also above the temperature of the triple point due to the heating, the ice changes over very rapidly into the liquid and/or gaseous phase, and can be removed via the regeneration valve. The regeneration of a cryopump—be it the regeneration of the pumping surfaces of the second stage or total regeneration—can therefore be executed faster, so that the required operation interruption times are significantly shorter.

In a cryopump operated by a dual- or multi-stage refrigerator and having pumping surfaces that have a temperature during operation of the pump that permits the adsorption of light gases and the condensation of additional gases, in a modification of the above-described method it is advantageous when, after initiation of the regeneration process, the connection between the pump interior and the backing is opened long enough that a desorption of the light gases has taken place at relatively low pressures. This step requires only a few minutes, and prevents high hydrogen concentrations in the pump interior.

In a cryopump operated with a dual-stage refrigerator, regeneration is particularly fast and advantageous when only the pumping surfaces of the second stage are to be regenerated. This method, in which only the pumping surfaces of the second stage are heated, can only be executed when the refrigerator is running. Because of this, the time required to bring the pumping surfaces of the second stage back to their operating temperature after regeneration is very short, particularly because the regeneration temperature must only slightly above the temperature of the triple point of the gas to be removed in order to be able to quickly remove the precipitates changing over into the liquid and/or gaseous phase at the increased pressure—and likewise above the pressure of the triple point of the gas to be removed.

To be able to execute the regeneration of the cryopump within the shortest possible time, it is necessary that precipitates changing over into the liquid or gaseous phase pass through the regeneration valve provided for this purpose. If the regeneration pressure is below the surrounding atmospheric pressure, the line connected to the regeneration valve must be equipped with a feed pump that is able to suction off the precipitates via the regeneration valve.

It is particularly advantageous to select the regeneration pressure to be so high that it is above the ambient pressure, and to configure the regeneration valve as a check valve. In this solution, a feed pump associated with the regeneration valve can be omitted. The regeneration valve opens as soon as the ambient pressure in the pump interior is exceeded. Gaseous precipitates and precipitates changing over into the liquid phase are pushed out through the open valve because of the overpressure in the pump, and thus quickly removed. In this solution, the control of the regeneration valve, which is a function of the pressure in the pump interior, is effected automatically when the ambient pressure is exceeded or not met. The result of utilizing these measures is that the pump down times can be shortened by a factor of 10. Of course, there is also the possibility of controlling a regeneration valve that is not configured as a check valve via control means as a function of the pressure in the pump interior or as a function of a change in temperature associated with the end of regeneration (e.g. in the region of the pumping surfaces or the regeneration valve), particularly when the regeneration pressure is less than the ambient pressure.

Because rapid removal of the precipitates in their liquid phase is possible, the inlet opening of the discharge line in which the regeneration valve is disposed should be located in the lower region of the radiation shield. Precipitates that are still in ice form and are separating from the pumping surfaces of the second stage also travel to this region. Thus, it is advisable to provide an additional heating element in this region. Funnels or grooves—heated, if necessary—can be disposed beneath the pumping surfaces of the second stage, to which the discharge line is connected.

The regeneration valve advantageously has a heating element. After passage of the cold liquids and/or gases, the heating element causes warming of the sealing surfaces, which are equipped with, for example, an elastomer sealing ring, so that after regeneration a vacuum-tight closure of the regeneration valve is assured. To prevent excessive heating of the valve, it is advantageous to provide a temperature sensor with which the heat output is controlled. Because a heat output is no longer necessary after completion of regeneration and after the closure and heating of the valve to the ambient temperature, the information provided by the temperature sensor can be used to initiate the necessary steps that follow regeneration—actuation of the backing pump, delayed deactivation of pumping surface heating, startup of the refrigerator or the like.

In regeneration experiments with dual-stage cryopumps, it was found repeatedly that, although only the pumping surfaces of the second stage were intended to be regenerated while the refrigerator was running, the temperature of the pumping surfaces of the first stage also rose to relatively high values. As a result, a relatively long period of cold operation of the pump always followed the very short time required for removing the precipitates, which was achieved with the method of the invention, because of the relatively high thermal load of the first stage. The cause of this thermal load is gases evaporating from the second stage that travel into the space between the radiation shield and the outer housing and form a thermal bridge there. Because the pressure in the interior of the pump is relatively high during regeneration, frequently even higher than the atmospheric pressure, this thermal bridge is particularly effective. The heat traveling from the outer housing with ambient temperature to the cold radiation shield thus represents a particularly high thermal load of the first stage.

An advantageous feature of a cryopump in accordance with the invention is that the pump is equipped with means that prevent to the greatest extent the described heat transfer from the housing to the gases located in the pump, and hence to the pumping surfaces of the first stage. This thermal insulation can be formed from a thermally poorly-conductive material disposed between the housing and the radiation shield. One particularly effective solution is to equip the cryopump with a vacuum insulation. The wall of the cryopump can be configured in a known way as a double wall. In another advantageous solution, the radiation shield itself forms the inside wall of this double wall. In these solutions, even at high pressures in the pump interior, a definitive heat transfer no longer takes place from the outer pump housing to the pumping surfaces of the first stage, so that these pumping surfaces essentially retain their low temperature. The time required to operate the refrigerator cold again after regeneration is significantly shorter.

BRIEF DESCRIPTION OF THE DRAWINGS

Further advantages and details of the invention are intended to be described below with reference to embodiments illustrated in FIGS. 1 through 7.

Shown are in.

DETAILED DESCRIPTION OF THE INVENTION

Figure 1:
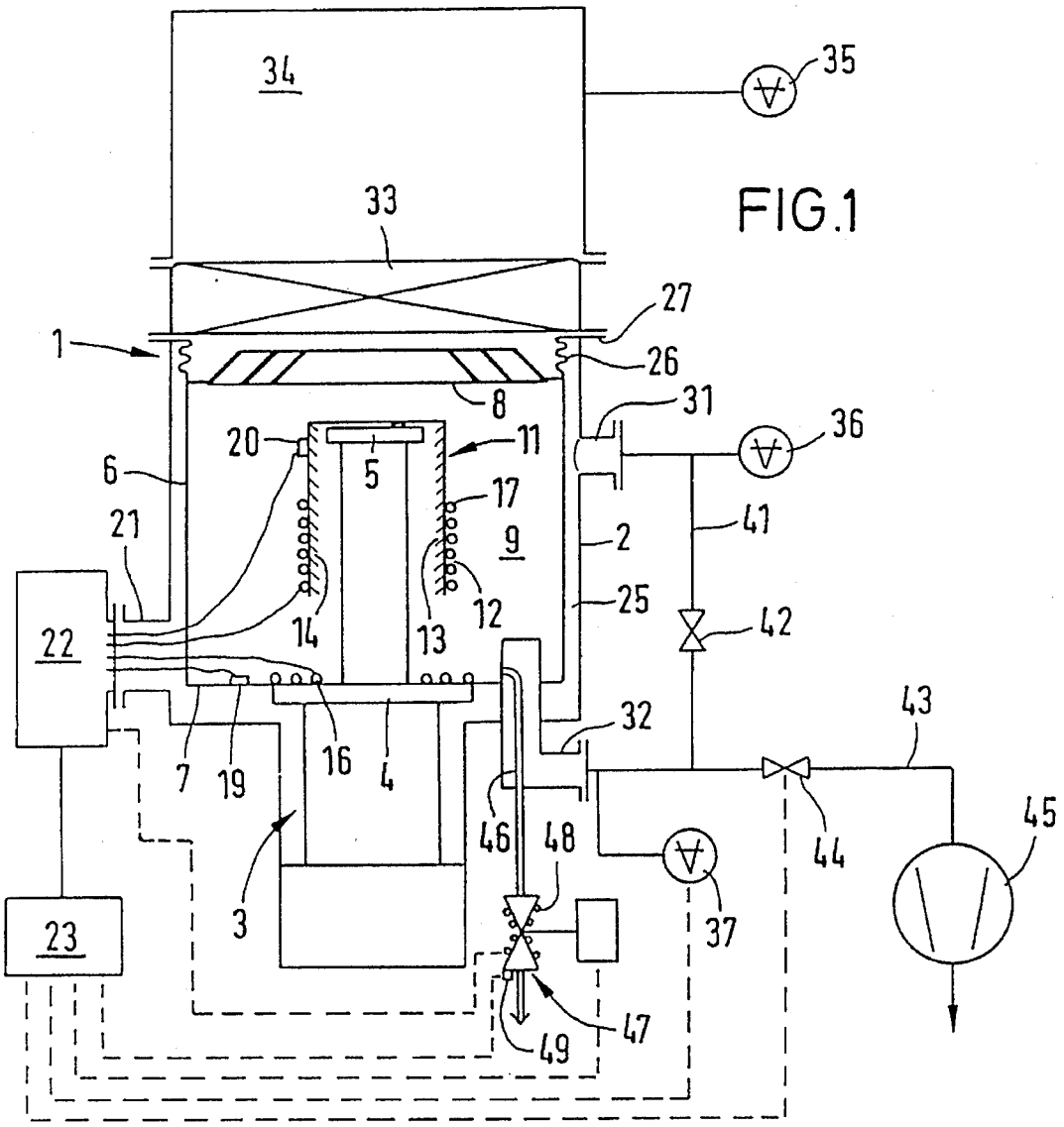
FIG. 1 schematically, a cryopump in accordance with the invention having control devices and supply devices, and FIGS. 2 through 7 sections through embodiments having a vacuum insulation.

In all drawing figures the cryopump is indicated by 1, its outer housing with 2, the refrigerator with 3, and its two stages with 4 and 5, respectively. Parts of the pumping surfaces of the first stage 4 include the pot-shaped radiation shield 6, which is open at the top and is secured by its bottom 7 to the first stage 4 in a manner that is thermally well-conductive and—if necessary—vacuum-tight, and the baffle 8, which is located in the inlet region of the cryopump and, together with the radiation shield 6, forms the pump interior 9. The baffle 8 is secured in a way not shown in detail to the radiation shield 6 in such a manner that it assumes the temperature of the radiation shield 6.

The pumping surfaces of the second stage, which are generally indicated by 11 and are formed, for example, by an approximately U-shaped piece of sheet metal, are located in the pump interior 9. The U-shaped piece of sheet metal is secured by its connecting piece to the second stage 5 of the refrigerator 3 in a manner that is thermally well-conductive, so that outer surface regions 12 and inner surface regions 13 result. The outer surface regions 12 form the condensation pumping surfaces of the second stage. The inner surface regions 13 are provided with an adsorption material 14. In these regions light gases are bound by means of cryosorption.

To be able to regenerate the pumping surfaces 6 through 8 and 11 through 14, which are charged with gases, heating elements are provided. They are formed by heat conductors 16 through 18. The heat conductors 16 for the pumping surfaces of the first stage 4 are located in the region of the bottom 7 of the radiation shield 6. The heat conductors 17 for the pumping surfaces of the second stage are secured to the outer pumping surface 12. In addition, it is also possible to equip the second stage 5 of the refrigerator 3 with heat conductors 18 (FIGS. 2, 3, 5 and 7). The current supply lines for the heating elements 16 through 18, and those leading to temperature sensors 19, 20 are guided out vacuum-tight through the radiation shield 6 and a connecting branch 21 in a way not shown in detail. A heat supply 22 that is controlled by the control unit 23 is connected to the connecting branch

21.

Figure 2:
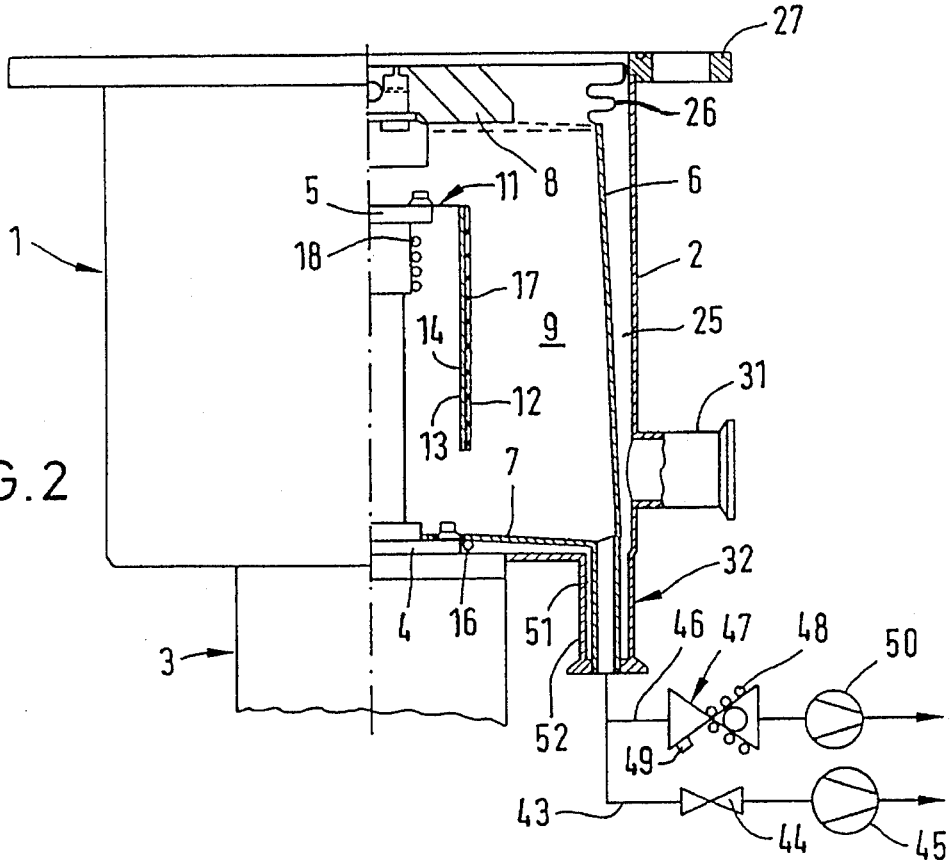
Figure 3:
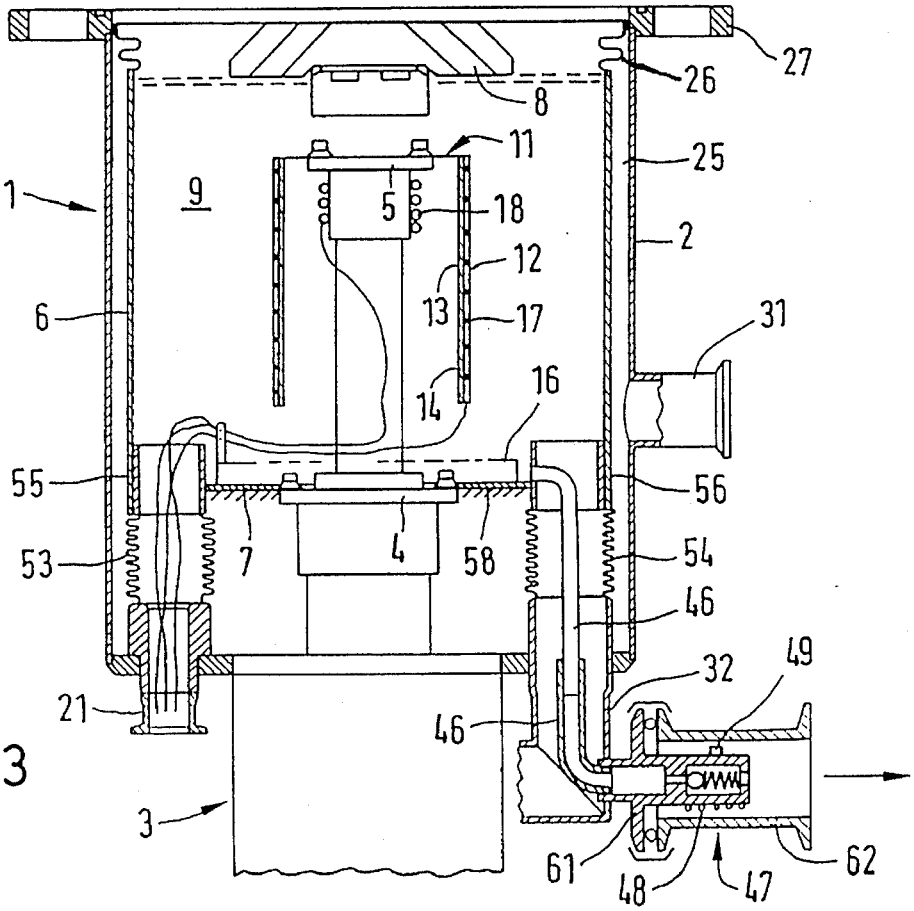

The embodiments in accordance with FIGS. 1 through 3 are equipped with a vacuum insulation, in which the radiation shield 6 is included. To separate the intermediate space 25, which is located between the outer housing 2 and the radiation shield 6 and which effects the vacuum insulation, from the pump interior 9, the radiation shield 6 is secured in a vacuum-tight manner to the first stage of the refrigerator 3. Moreover, the upper edge of the radiation shield 6 is connected to the outer housing 2 via a bellows 26 of thermally poorly-conductive material (e.g. special steel). In the embodiments shown, the outer housing 2 is equipped with a flange 27. The bellows 26 extends between the flange 27 and the attachment of the radiation shield 6. Its length is selected such that the heat flowing across the bellows 26 from the outer housing 2 or the flange 27 is negligible.

In addition to the connecting branch 21 for guiding the heat lines through, in some of the drawing (FIGS. 1–3, 5 and 7) the embodiments are equipped with further connecting branches 31, 32. The connecting branch 31 terminates in the intermediate space 25. The connecting branch 32 terminates in the pump interior 9. In the embodiments of FIGS. 1 through 3, connecting branch 32 is guided vacuum-tight through the intermediate space 25.

In the schematically illustrated embodiment of FIG. 1, the cryopump 1 is connected to the recipient 34 via the valve 33. This inlet valve 33 and the recipient 34 are only shown in FIG. 1. The pressure-measuring apparatus 35 is provided for observing and measuring the pressure in the recipient 34. Pressure-measuring apparatuses 36 or 37 are also connected to the connecting branches 31 and 32.

Furthermore, the connecting branches 31 and 32 are connected to one another via the line 41 (FIGS. 1 and 5), which is provided with the valve 42. Moreover, the connecting branch 32 is connected via the line 43 to the valve 44 at the inlet of the vacuum pump 45. In this instance the pump is preferably an oil-free backing pump, for example a diaphragm vacuum pump.

To start up a pump of the type shown in FIG. 1, first the pump interior 9 and the intermediate space 25 are evacuated with the aid of the vacuum pump 45 when valve 33 is closed and valves 42, 44 are open. The refrigerator 3 is put into operation at a pressure of approximately $10^{-1}$ to $10^{-2}$ mbar, so that the pumping surfaces can be operated cold. The valve 44 is closed approximately at the same time. During cold operation and after the operating temperature has been reached, the pumping surfaces of the cryopump bind the gases still in the intermediate space 25 (valve 42 is still open), so that a pressure of less than $10^{-5}$ is reached relatively quickly in these spaces. Afterward the valve 42 is closed so that the intermediate space 25 has the function of an extremely efficient vacuum insulation.

It is advantageous to configure the valve 42 as a control valve. The control is effected as a function of the pressures in the intermediate space 25, measured with the measuring apparatus 36, and in the pump interior 9, measured with the measuring apparatus 37. The control is effected, for example, such that the valve 42 only opens when the pressure in the intermediate space 25 rises to approximately $10^{-3}$ mbar, and remains closed during time periods in which this pressure is less than $10^{-3}$, so that the intermediate space is later evacuated. This ensures that the pump 1 itself continuously assures the maintenance of the insulating vacuum in the intermediate space 25.

During cold operation of the cryopump, a backing pressure of approximately $10^{-1}$ mbar is also generated in the recipient 34 with the aid of a backing pump (for example the backing pump 45). In a cold-operating pump, and after this pressure has been reached in the recipient, the valve 33 can be opened and the desired pump operation can be initiated.

In the applications typical for cryopumps, the recipient 34 must be repeatedly evacuated, that is, the valve 33 must be respectively closed and re-opened. These pump cycles can be repeated until the pump capacity is attained, i.e., until the pumping surfaces must be regenerated. For this purpose the pumping surfaces to be regenerated are heated, and the separating precipitates are removed via the line 46 provided with the regeneration valve 47. The regeneration valve 47 is equipped with a heating element 48 and a temperature sensor 49. FIG. 1 shows that the heating element 48 is connected to the heat supply 22. The signal sent by the temperature sensor is supplied to the control device 23. In the embodiment of FIG. 1, the operation of the valves 44 and 47 is effected by means of the control device 23. For this purpose, signals sent by sensors 19 and 20 at the two stages 4, 5 of the refrigerator 3 are also supplied to the control device 23. Moreover, at least the pressure-measuring apparatus 37, which displays the pressure in the pump interior 9, is connected to the control device 23.

In the embodiments in FIGS. 2 and 3, the valve 47 is configured as a check valve. It opens at a specific pressure in the pump interior 9. If the regeneration valve 47 leads directly into the environment or into a line that leads further and has ambient pressure, then the pressure in the pump interior 9 must be above the ambient pressure so that the valve 47 opens. Should the valve 47 already open at a pressure less than the ambient pressure, then a suitable fan 50 must be disposed in the line that leads further.

It is essential that no heat be able to flow in from the outside onto the radiation shield 6, and also not via the wall of the connecting branch 32 that terminates in the pump interior 9 and must therefore be guided vacuum-tight through the radiation shield 6 in the embodiments of FIGS. 1, 2 and 3. An advantageous construction of the embodiment of the connecting branch 32 is shown in FIG. 2. The connecting branch 32 is formed by two concentric pipe segments 51, 52. The inside pipe terminates in the pump interior and is sealingly connected to the radiation shield 6, for example by means of welding. In the outlet region the inside pipe 51 is connected vacuum-tight to the outside pipe 52, for example likewise by means of welding. The outside pipe 52 terminates in the intermediate space 25 and is connected vacuum-tight with the outer housing 2. Because of this, the insulating vacuum of the intermediate space 25 is also maintained in the annular space between the two pipes 51 and 52. The inner pipe 51 comprises thermally poorly-conductive material. e.g. special steel, and is selected to be so long that the heat transfer from the outside onto the radiation shield 6 is negligible.

To continually assure a discharge of the liberated condensate in different fitting positions, the bottom 7 and the lateral wall of the radiation shield 6 are inclined with respect to a horizontal or vertical line. The inclination is respectively selected such that the termination of the pipe 51 always forms the lowest point in the horizontal and vertical positions of the pump. During regeneration of the pumping surfaces of the second stage, draining liquids therefore always travel into the inner pipe 51, to which the discharge line 46 and—independently thereof—the line 43 leading to the backing pump 45 are connected.

FIG. 3 shows an embodiment in which the thermal insulation between the radiation shield 6 and the outwardlyguided connecting branches (21, 32) is formed by bellows 53, 54 of sufficient length. The bellows 53, 54 are disposed inside the pump, so that the respectively outer segments of the connecting branches 21, 32 can be kept short.

Pipe segments 55, 56, which partially protrude into the pump interior 9, are connected to the bellows 53, 54, toward the pump interior 9. This ensures that precipitates changing over into the liquid state during the regeneration of the pumping surfaces of the second stage 5 do not travel inside the connecting branches 21, 32. To permit rapid removal of liquid gases, the discharge line 46 is guided through the connecting branch 32. This terminates laterally in the pipe branch 56, directly above the bottom 7 of the radiation shield 6, and is guided out of the connecting branch 32 outside the cryopump 1. Therefore, liquids that form and drain off during the regeneration of the pumping surfaces of the second stage can flow away. Because the heating element 16 is disposed in the region of the bottom of the radiation shield 6, separating precipitates still in the frozen state can rapidly be changed over to the liquid state.

In the embodiment of FIG. 3, the underside of the bottom 7 of the radiation shield 6 is also coated with adsorption material 58. This adsorption material is thus located in the intermediate space 25, and also contributes to the maintenance of the insulating vacuum. In this solution (a sufficiently sealed embodiment of the intermediate space 25), there even exists the possibility of omitting the intermittent connection of the intermediate space 25 with the interior 9 of the pump. As a consequence of the provision of adsorption material on surface regions that are cold when the refrigerator 3 is running, an insulating vacuum is always assured in the intermediate space 25 during operation of the pump. In place of the adsorption material, getter materials may also be provided.

Figure 4:
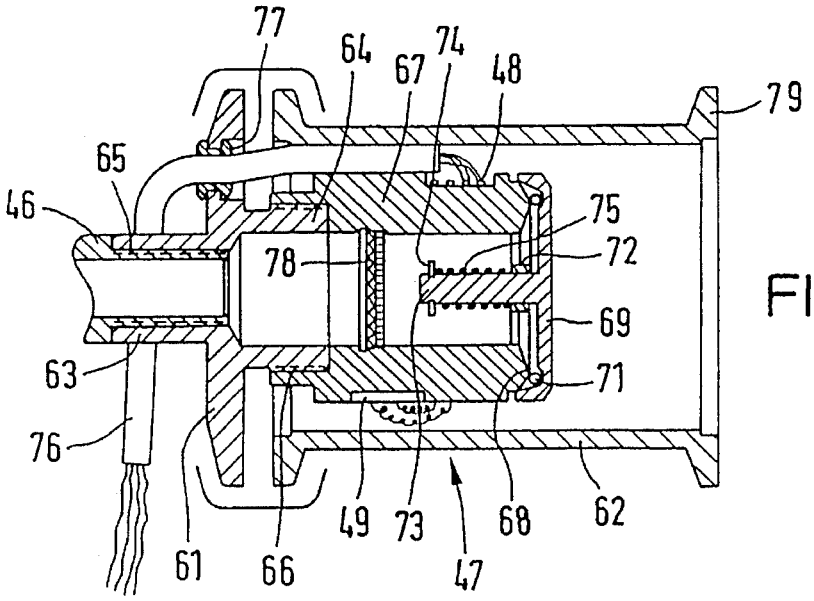

In the embodiments of FIGS. 3 and 4, the discharge line 46 terminates in a flange 61 which, with an outer pipe segment 52, supports the regeneration valve 47 configured as a check valve. The flange 61 is equipped on both sides with pipe connecting branches 63, 64 (FIG. 4), which are respectively provided with a thread 65 or 66. With the aid of the thread 65, the flange 61 is connected to the discharge line 46. The essentially cylindrical valve housing 67 is screwed onto the thread 66. The free face end of the valve housing 67 forms the valve seat 68, with which a valve disk 69 and a sealing ring 71 are associated. A central sleeve 72, in which a central pin 73 of the valve disk 69 is guided, is held in the face-end opening of the valve housing 67. A compression spring 75 that generates the necessary force is disposed between the sleeve 72 and a retaining ring 74 on the pin 73. If the pressure in the pump interior 9 exceeds the pressure exerted on the valve disk 69, as well as the closing force of the spring 75, the valve 47 assumes its open position.

On its outside, the valve housing 67 has the heating element 48 and the temperature sensor 49, preferably a PT 100. Supply and signal lines 76 are guided out together through an additional, sealed opening 77 in the flange 61. A filter 78 through which the precipitates to be carried off have flowed is disposed inside the valve housing, so that impurities can be kept away from the valve seat 68. In another embodiment, the filter 78 can also be disposed at a different point of the discharge line. The outer pipe segment 62 is secured to the flange 61 with the aid of a clamp. Further discharge lines can be attached to its free face end 79.

Figure 5:
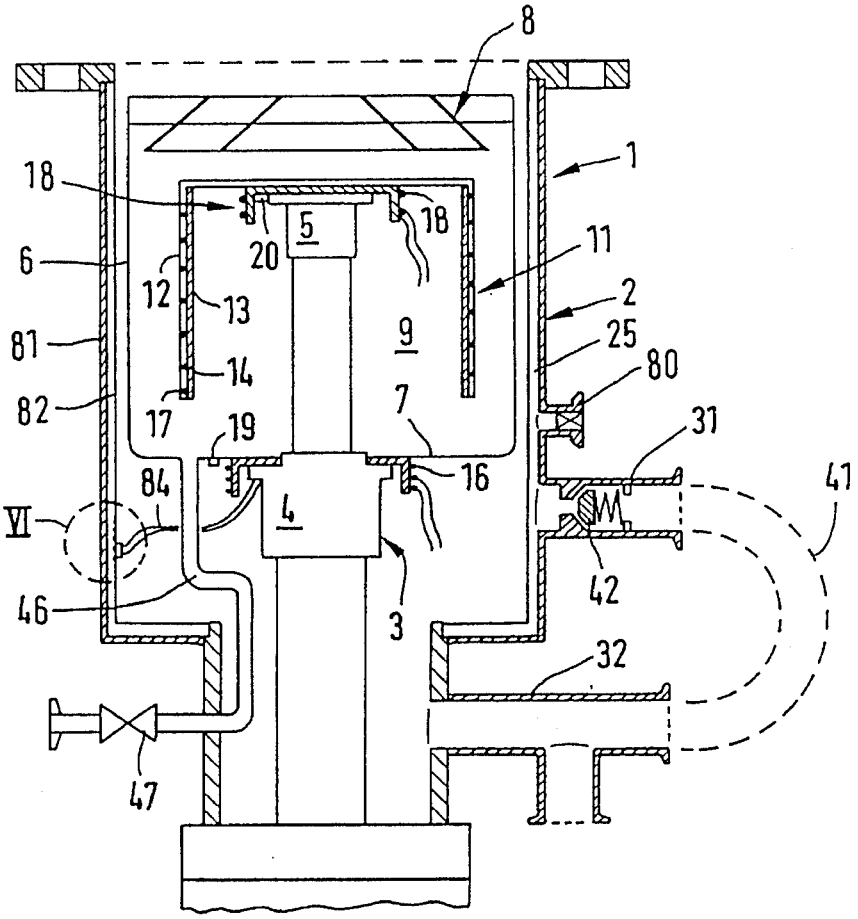
Figure 6:
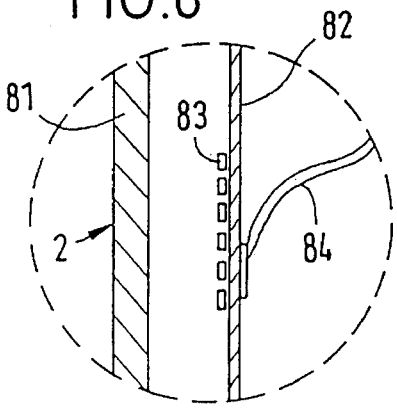
Figure 7:
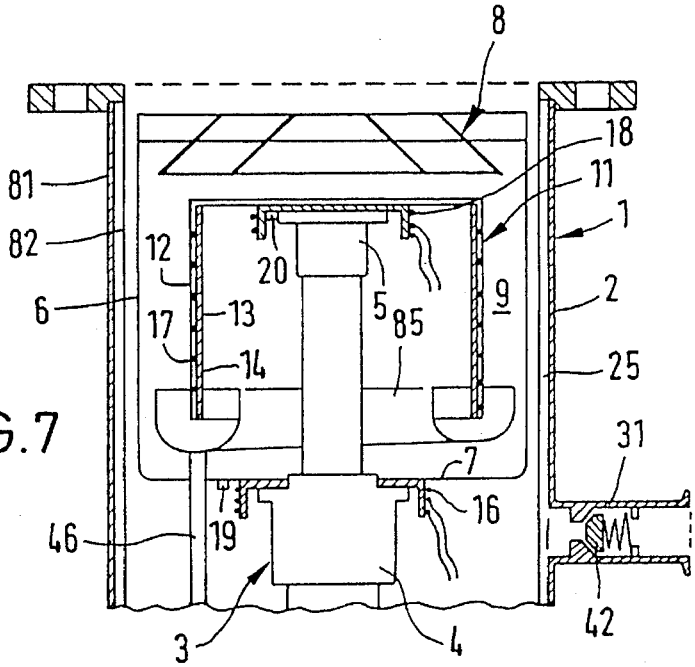

The embodiments in accordance with FIGS. 5 through 7 are equipped with a vacuum insulation 25 that is independent of the radiation shield 6. The pump housing 2 is configured to have two walls. A relatively stable outer wall 81 stands opposite an inner wall 82, which is as thin as possible. A thin inner wall 82, preferably of special steel, has the advantage of a small heat-conducting capacity and small heat capacity. During the regeneration of the pumping surfaces, i.e., when the pressure in the pump interior 9 is high, the inner wall 82 remains cold so that a heat flow from the pump housing 2 onto the radiation shield 6 is negligible. The desired effect can also be supported in that, on its side facing the pump interior 9, the inner wall 82 is blackened—at least partially—or connected locally thermally connected to the radiation shield 6.

With a very thin inner wall 82 (for example a sheet of special steel having a thickness of 0.5 mm and less), it must be ensured that the pressure in the insulating vacuum is not permitted to be significantly higher than in the pump chamber 9, and preferably remains within the mbar range. It is therefore advantageous when the insulating vacuum 25 can be connected to the pump interior 9 via the line 41. If the valve 42 disposed in the line 41 is configured as a controlled valve or a check valve that assumes its open position when the pressure in the insulating vacuum is, for example, approximately 100 mbar higher than in the pump interior, that is, produces the connection between the insulating vacuum 25 and the pump interior 9, when the pressure in the pump interior 9 drops below the pressure of the insulating vacuum 25, then an overly high pressure of the insulating vacuum that could lead to a deformation of the inner wall 82 is prevented. The evacuation of the intermediate space 25 is effected via a separate pump connecting branch 80, which is equipped with a sealing valve.

Also, in the solution in accordance with FIGS. 5 through 7 it is advantageous when an adsorption material or a getter material 83 is located inside the insulating vacuum 25 (see FIG. 6). It serves to maintain the insulating vacuum, even when a connecting line 41 with the valve 42 is not provided. The effect of adsorption material 83 can be intensified through cooling. For this purpose a cold bridge 84 is provided that has a thermally well-conducting cord stranded wire and that connects the first stage 4 of the refrigerator 3 with the region of the inner wall 82 in which the adsorption material 83 is located. Another possibility is to blacken the radiation shield 6—at least partially—on its outside.

In the embodiment in accordance with FIG. 7, the pumping surfaces 11 have a rotationally symmetrical shape. A circular groove 85 is located beneath the pumping surfaces. The precipitates separating from the pumping surface 12 in particularly liquid or ice form travel into the groove 85, which can be heated to accelerate the thaw of the precipitates separating in ice form. The precipitates are removed in the above-described way via the discharge line 46 connected at the lowest point of the groove 85.

We claim:

1. A cryopump, comprising:

an exterior housing having an interior space formed therein;

a refrigerator at least partially located within the interior space, said refrigerator cooling said cryopump and having at least one pumping surface located within the interior space;

a heating element attached to the pumping surface for heating the pumping surface;

an inlet valve attached to the housing and opening into the interior space;

a backing pump operatively connected to the interior space; and a regeneration valve having a heating element and a temperature sensor for controlling said heating element, and being connected by a discharge line with the interior space for the removal of precipitates formed therein.

2. A cryopump as defined in claim 1, further comprising a feed pump attached to said discharge line at a position after said regeneration valve relative to said exterior housing.

3. A cryopump as defined in claim 1, further comprising a radiation shield located within said exterior housing and defining the interior space, said radiation shield having a lower region located away from said inlet valve, said discharge line having an inlet opening located in the lower region of said radiation shield.

4. A cryopump as defined in claim 3, wherein said radiation shield has walls, and a bottom located in the lower region, at least one of said walls and said bottom being inclined so that the inlet opening is located at a lowest point of said radiation shield.

5. A cryopump as defined in claim 3, further comprising an additional heating element located in the lower region of said radiation shield.

6. A cryopump as defined in claim 3, further comprising at least one of funnels and grooves located beneath the pumping surface and terminating at the inlet opening of said discharge line.

7. A cryopump as defined in claim 6, wherein said at least one of funnels and grooves is heated.

8. A cryopump as defined in claim 1, wherein said regeneration valve is a check valve.

9. A cryopump as defined in claim 1, wherein said regeneration valve includes two sealing surfaces engagable with each other for closing the regeneration valve; further comprising a filter located in one of the regeneration valve and the discharge line in a region between an inlet opening of said discharge line and said two sealing surfaces.

10. A cryopump as defined in claim 1, wherein said regeneration valve has an essentially cylindrical housing having a first face defining an opening and forming a valve seat, the opening having a sleeve held centrally therein, said regeneration valve further comprising a valve disc having a centrally located pin projecting therefrom and being guided within the sleeve.

11. A cryopump as defined in claim 10, wherein said regeneration valve includes a flange, and a pipe segment surrounding the cylindrical housing, said pipe segment and said cylindrical housing each being secured to said flange, and said discharge line terminating at said flange.

12. A cryopump as defined in claim 1, further comprising a plurality of sensors for actively controlling said regeneration valve.

13. A cryopump as defined in claim 1, wherein the interior space is formed by a plurality of interior surfaces; further including means for preventing a heat transfer from said exterior housing to said interior surfaces caused by a gas within the interior space.

14. A cryopump as defined in claim 13, wherein the interior surfaces are formed at least partially by a radiation shield located within said exterior housing, said preventing means comprising a thermally poorly-conductive material located between said exterior housing and said radiation shield.

15. A cryopump as defined in claim 13, wherein said exterior housing comprises an interior wall and an exterior wall surrounding the interior wall to form a closed intermediate space therebetween; said preventing means comprising means for evacuating the closed intermediate space.

16. A cryopump as defined in claim 15, wherein at least the interior wall is composed of a thermally poorly-conductive steel.

17. A cryopump as defined in claim 15, wherein the interior wall has a thickness less than 1 mm.

18. A cryopump as defined in claim 15, wherein the interior wall has a thickness of about 0.5 mm.

19. A cryopump as defined in claim 15, further comprising a first connecting line terminating in the closed intermediate space, a second connecting line terminating in the interior space, and a connecting valve connecting said first connecting line with said second connecting line.

20. A cryopump as defined in claim 19, wherein said connecting valve comprises one of a control valve and a check valve.

21. A cryopump as defined in claim 20, wherein said connecting valve is open when a pressure within the interior space is approximately $10^{-3}$ mbar and less, and is closed when the pressure is greater than $10^{-3}$ mbar.

22. A cryopump as defined in claim 15, further comprising at least one connecting line terminating in the interior space and passing through the closed intermediate space, said at least one connecting line comprising a first pipe located within a second pipe.

23. A cryopump as define in claim 22, wherein the interior surfaces are formed at least partially by a radiation shield located within said exterior housing, said at least one connecting line being guided through a lower region of said radiation shield and including an edge protruding into the interior space.

24. A cryopump as defined in claim 22, wherein said discharge line is guided through said at least one connecting line.

25. A cryopump as defined in claim 15, further comprising at least one connecting line terminating in the interior space and passing through the closed intermediate space, said at least one connecting line including a bellows located within the intermediate space and composed of a thermally poorly-conductive material.

26. A cryopump as defined in claim 25, wherein the thermally poorly-conductive material is a steel.

27. A cryopump as defined in claim 15, wherein said closed intermediate space is a vacuum-tight chamber; further comprising one of getters and sorption materials provided on a surface of the vacuum-tight chamber for cooling the surface of the vacuum-tight chamber.

28. A cryopump as defined in claim 27, wherein the interior wall of said exterior housing has a first surface facing the vacuum-tight chamber and having the sorption material provided thereon, and a second surface facing the interior space; further comprising a cold bridge connecting a first stage of said refrigerator with said second surface.

29. A cryopump as defined in claim 13, wherein the interior surfaces are formed at least partially by a radiation shield located within said exterior housing, said radiation shield and said exterior housing forming a closed vacuum-tight chamber therebetween; said means comprising means for evacuating the vacuum tight chamber; further comprising sorption materials provided on a surface of said radiation shield facing the vacuum tight chamber for cooling the surfaces of the vacuum-tight chamber.

30. A cryopump as defined in claim 29, wherein the sorption material is located in a bottom region of said radiation shield.

31. A cryopump as defined in claim 15, further comprising a radiation shield located within said exterior housing and having at least a partially blackened surface.

32. A cryopump as defined in claim 13, wherein said refrigerator is a cold source having at least a first stage, and a second stage composed of the at least one pumping surface, at least one of the interior surfaces comprising a radiation shield being heat conductively connected with the first stage and forming a vacuum-tight chamber with said exterior housing, said at least one pumping surface of said second stage including a plurality of low-temperature pumping surfaces located within the interior space.

33. A cryopump as defined in claim 32, wherein said radiation shield is connected vacuum-tight with said first stage; further comprising a thermally poorly-conductive, vacuum-tight component that compensates for thermal movements connecting an upper edge of said radiation shield with said exterior housing.

34. A cryopump as defined in claim 33, wherein said thermally poorly-conductive, vacuum-tight component comprises a bellows.

35. A cryopump as defined in claim 32, wherein said radiation shield is connected vacuum-tight with said first stage, and said exterior housing includes an inlet flange; further comprising a thermally poorly-conductive, vacuum-tight component that compensates for thermal movements connecting an upper edge of said radiation shield with said inlet flange.

* * * * *